US005244494A

United States Patent [19]

Cavanagh

[11] Patent Number: 5,244,494

[45] Date of Patent: Sep. 14, 1993

[54] AUTOGENOUS ROASTING OF IRON ORE

[76] Inventor: Patrick E. Cavanagh, 95 Balmoral Avenue, Toronto, Ontario, Canada, M4V 1J5

[21] Appl. No.: 851,964

[22] Filed: Mar. 16, 1992

[51] Int. Cl.[5] ..... C22B 1/16

[52] U.S. Cl. ..... 75/749; 75/472; 423/634

[58] Field of Search ..... 423/634; 75/749, 472

[56] References Cited

FOREIGN PATENT DOCUMENTS 1097084 3/1981 Canada ..... 423/634

*Primary Examiner*—Melvyn J. Andrews

*Attorney, Agent, or Firm*—Sim & McBurney

[57] ABSTRACT

Iron ore concentrate is converted to magnetic gamma hematite in an autogenous roasting operation which is self-sustaining. The iron ore concentrate is preheated and contained magnetite is oxidized to hematite. Hematite is reduced to magnetite using carbon monoxide. After cooling, the magnetite is oxidatively exothermically converted to magnetic gamma hematite. The thermal energy resulting from the latter step is recycled to the preheating and reduction steps while thermal energy resulting from the cooling step also is recycled to those steps. The magnetic gamma hematite may be subjected to magnetic separation to produce a very low silica high purity iron oxide concentrate, which may be blended with high silica concentrate to provide a pellet feed for making blast furnace feed pellets.

11 Claims, 6 Drawing Sheets

AUTOGENOUS ROASTING OF IRON ORE

FIELD OF INVENTION

This invention relates to the roasting of iron ore, particularly the thermal conversion of iron ore to gamma hematite by an autogenous roasting process.

BACKGROUND TO THE INVENTION

When iron ores are roasted at temperatures above about 1500° F., the magnetite mineral contained in the ore oxidizes rapidly enough to act as a significant source of heat for the process. The fuel value of magnetite burned in this way is about 7000 BTU/lb. When magnetite is burned, hematite is produced.

Hematite, naturally-occurring or produced from magnetite, can be reduced to artificial magnetite, using hot carbon monoxide as reducing agent. When conditions are properly controlled, a small amount of heat is generated in the conversion process.

Artificial magnetite can be burned by oxidation at low temperatures to produce magnetic gamma hematite. In this latter reaction, the exothermic heat produced is so substantial that the overall three-step process can be made self-sustaining.

SUMMARY OF INVENTION

The present invention provides such a process, effected in a unique way. In one aspect, therefore, the present invention provides a closed cycle system of autogenous roasting of iron ore to form magnetic gamma hematite (maghemite) which, after initially being brought up to the operating temperature and steady operating conditions, is self-sustaining.

GENERAL DESCRIPTION OF INVENTION

The autogenous roasting process of the invention needs initial thermal energy to start it, but once started and operating temperature and steady state conditions have been established, the thermal energy generation enables a self-sustaining process to be provided. The richer the iron ore feed to the process is in iron content, the easier are the establishment and control of the reactions. Such initial thermal energy may be provided by electric elements.

A feed iron content (acid soluble iron) of more than about 40%, usually more than about 50%, in the iron ore concentrate is required for an effective process. The mixed metamorphised magnetite/hematite iron ores of the Labrador Trough are particularly useful feeds for the process. High purity concentrates have been produced from the spiral concentrates of past and present operating mines by using the autogenous roast process of the invention, followed by magnetic concentration of the product.

The violent shattering of mineral particles by an approximately 10% increase in volume accompanying the conversion of porous artificial magnetite to magnetic gamma hematite is a basic reason for the excellent results obtained by magnetically concentrating the roasted product, as described in more detail below.

It has been found difficult to control the process in shaft furnace and high temperature kiln equipment. A new approach, using a three stage rotary cooler to utilize the exothermic heat generated, and to control the violent oxidation of the artificial magnetite to magnetic gamma hematite forms one aspect of the invention (see FIG. 2).

Figure 1:
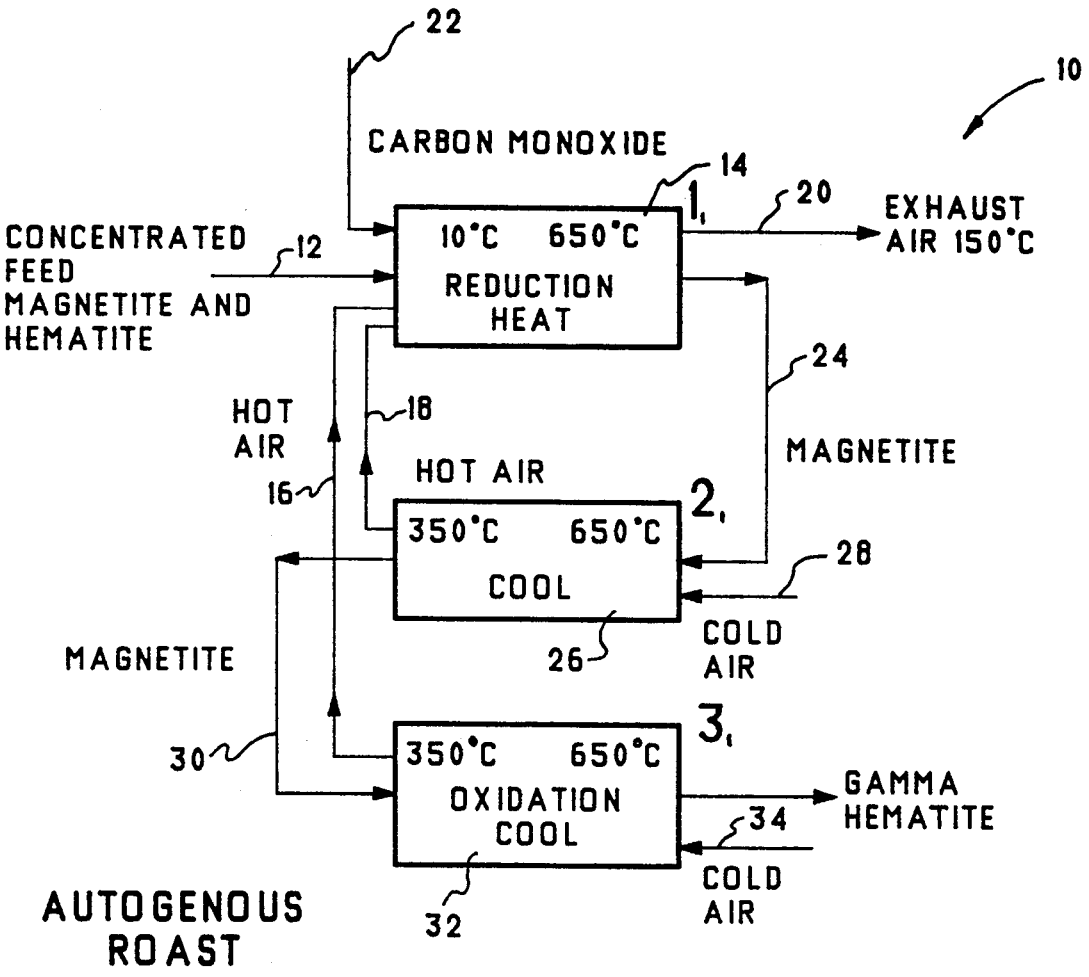
FIG. 1 is a schematic illustration of an autogenous roast process provided in accordance with one embodiment of the invention.

The autogenous roasting of iron ores in accordance with the present invention requires three distinct operations, as illustrated schematically in FIG. 1.

The first operation (Step 1—FIG. 1) involves heating the iron ore and reducing the hematite content to artificial magnetite at less than about 750° C. with a reducing gas rich in carbon monoxide, in accordance with the equation:

$$\text{Hematite } (Fe_2O_3) + CO \rightarrow \text{Magnetite } (Fe_3O_4) + CO_2$$

Any magnetite present in the ore fed to the first operation is not affected by this reduction step, provided that the temperature used is not above about 750° C. At higher temperatures, magnetite shrinks enough to become a denser less reactive material, which is undesirable.

The artificial magnetite produced by this first operation is porous and reactive. When the carbon monoxide content of the hot gas used is over about 65%, a small amount of heat is generated by the reduction reaction, sufficient to sustain the reaction. Generally, the gas ratio of $CO:CO_2$ is at least about 60:40 by volume.

The hot mixture of natural and artificially-reduced magnetite must be cooled to less than about 400° C. (Step 2—FIG. 1) in an inert gas atmosphere to prepare the mixture for the final oxidation step. The heat recovered from this cooling step is used to help maintain the temperature in the first reduction step.

Following such cooling operation and at a temperature of about 350° C., cold air is supplied at a carefully controlled rate to oxidize all the magnetite to magnetic gamma hematite. The artificial magnetite is very porous and so reactive that efficient cooling must be supplied to keep the reaction temperature below about 400° C. The reaction involved (Step 3—FIG. 1) is represented by the equation:

$$\text{Magnetite } (Fe_3O_4) + \text{Air } (O_2) \rightarrow \text{Gamma Hematite } (Fe_2O_3)$$

The heated gas from this cooling step is used to help maintain the temperature in the first reduction step.

Figure 2:
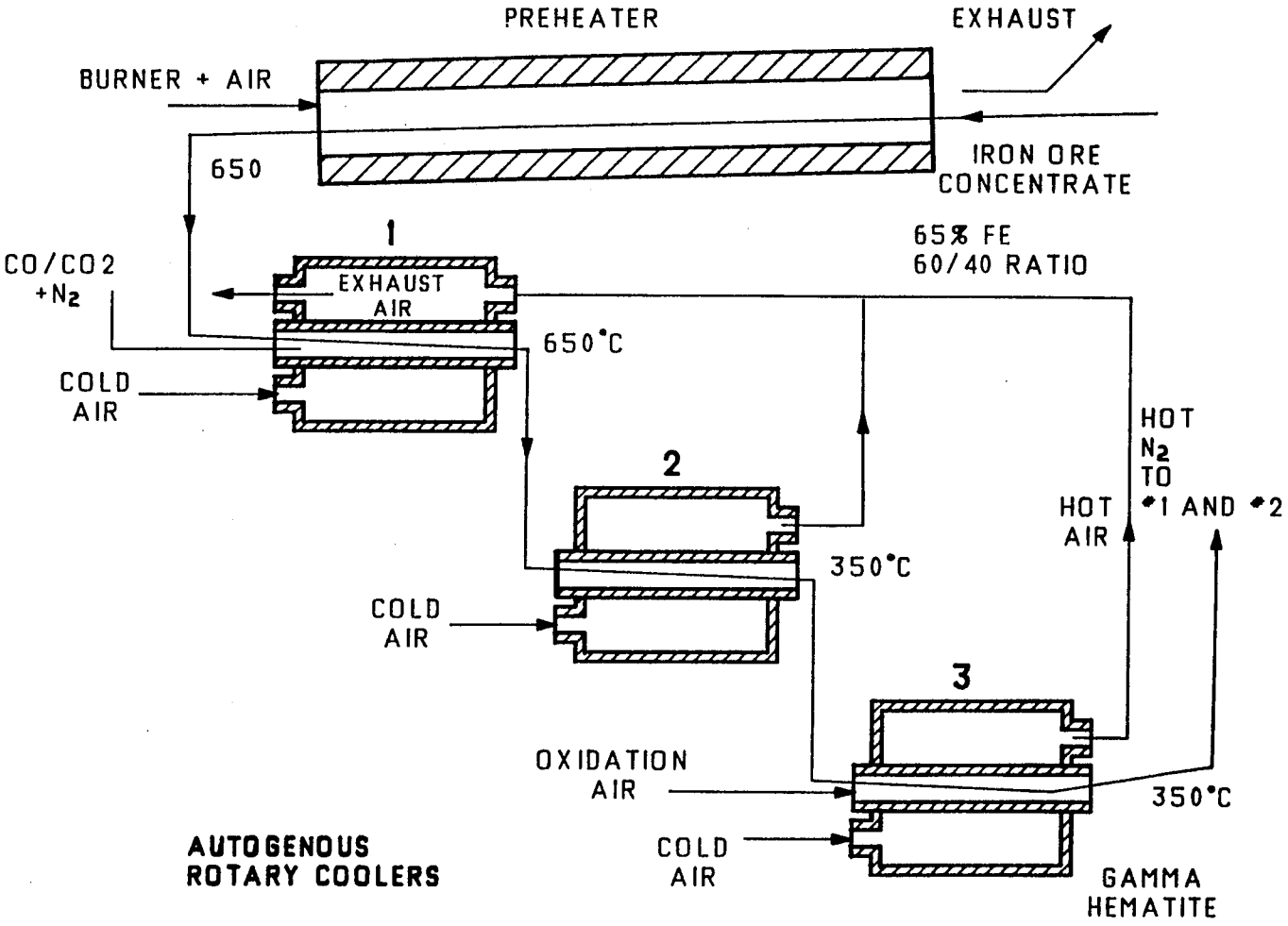
FIG. 2 is a schematic illustration of an autogenous roast process provided in accordance with another embodiment of the invention.
Figure 3:
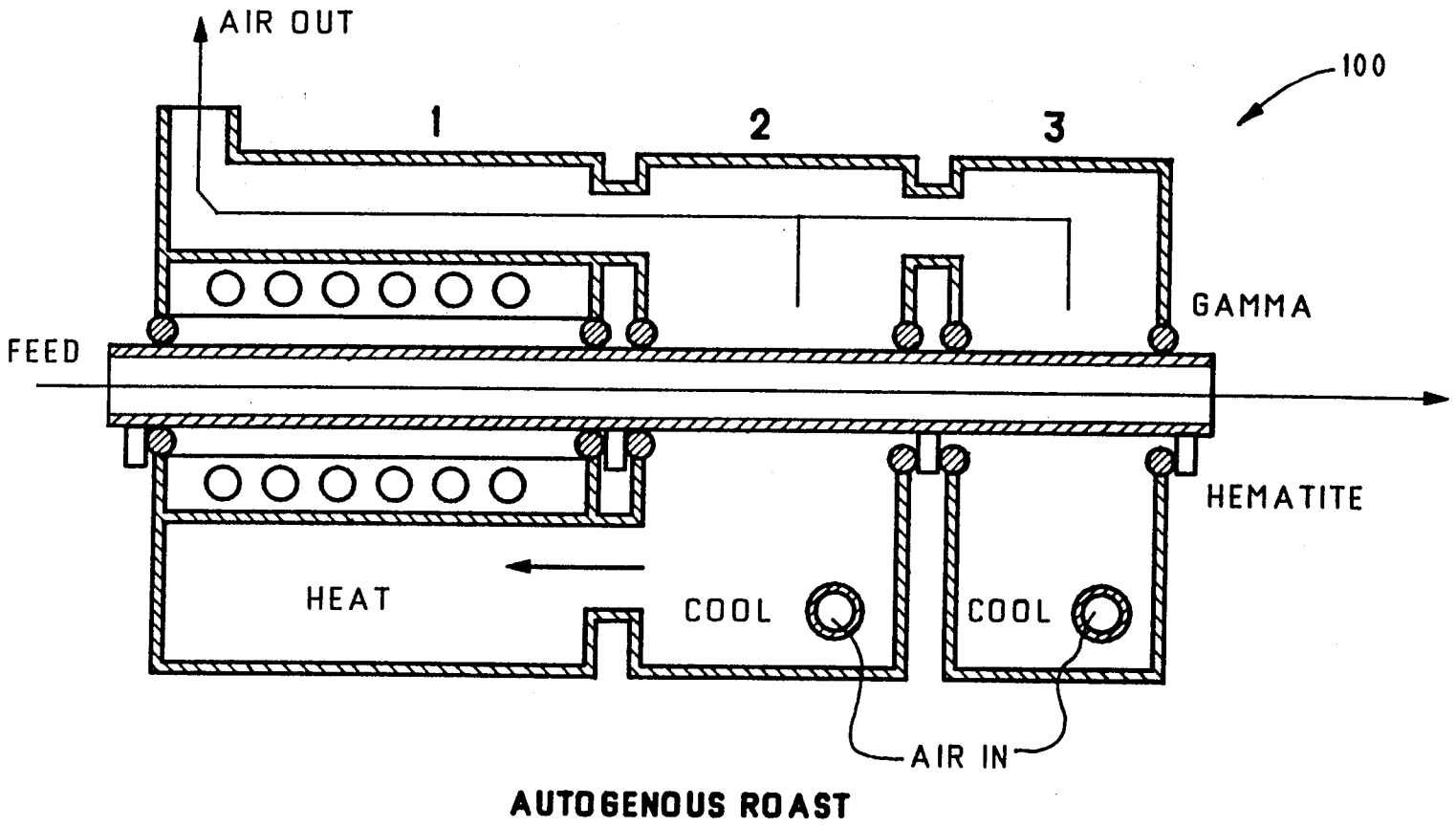
FIG. 3 is a schematic illustration of an autogenous roast process provided in accordance with a further embodiment of the invention.
Figure 4:
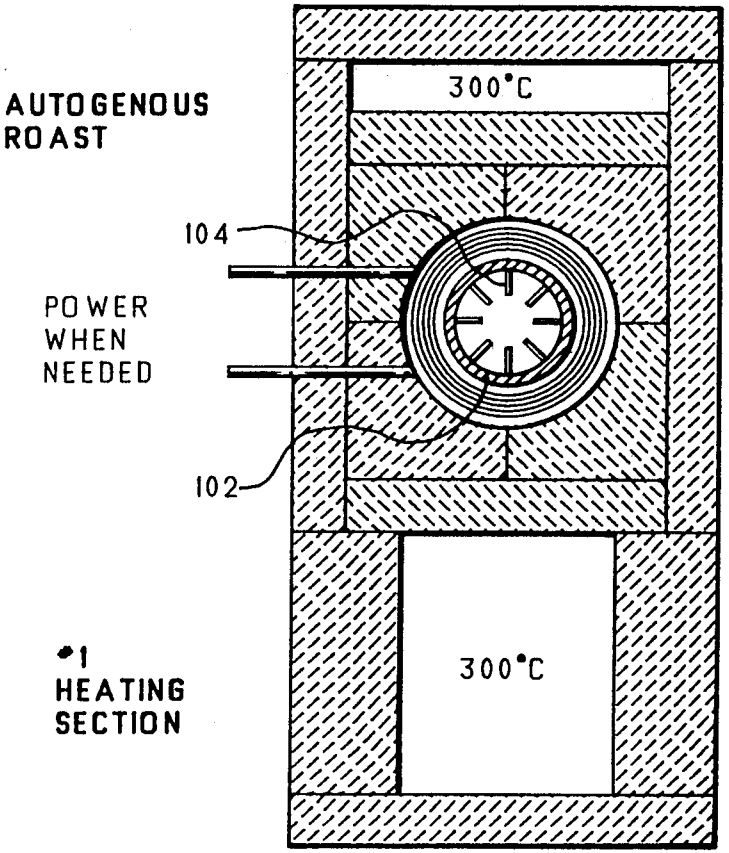
FIG. 4 is a sectional view taken on line 4—4 of FIG. 4 showing details of the heating section of the apparatus.

The autogenous process provided in accordance with the invention may be carried out in separate rotating coolers for each step, as illustrated in FIG. 2. Alternatively, a single unit can be used, with provision for separating the different atmospheres, and recycling the hot gases to the first preheat and reduction steps, as illustrated in FIGS. 3 and 4.

A rotary cooler is an externally heated or cooled high temperature metal alloy tube. Process temperatures are relatively low at about 700° C. maximum. Alloys resistant to oxidation, carburization and sulphur, at about 700° C., such as Monel metal and Fahralloy (35Cr/15 Ni), are suitable as materials of construction.

In this embodiment, external electric heating of the reduction keeps gas volume and velocity low. Only reaction gases are located within the cooler. The lifters shown in FIG. 4 give excellent contact of gases with the fine concentrate charge within the rotary coolers.

Figure 5:
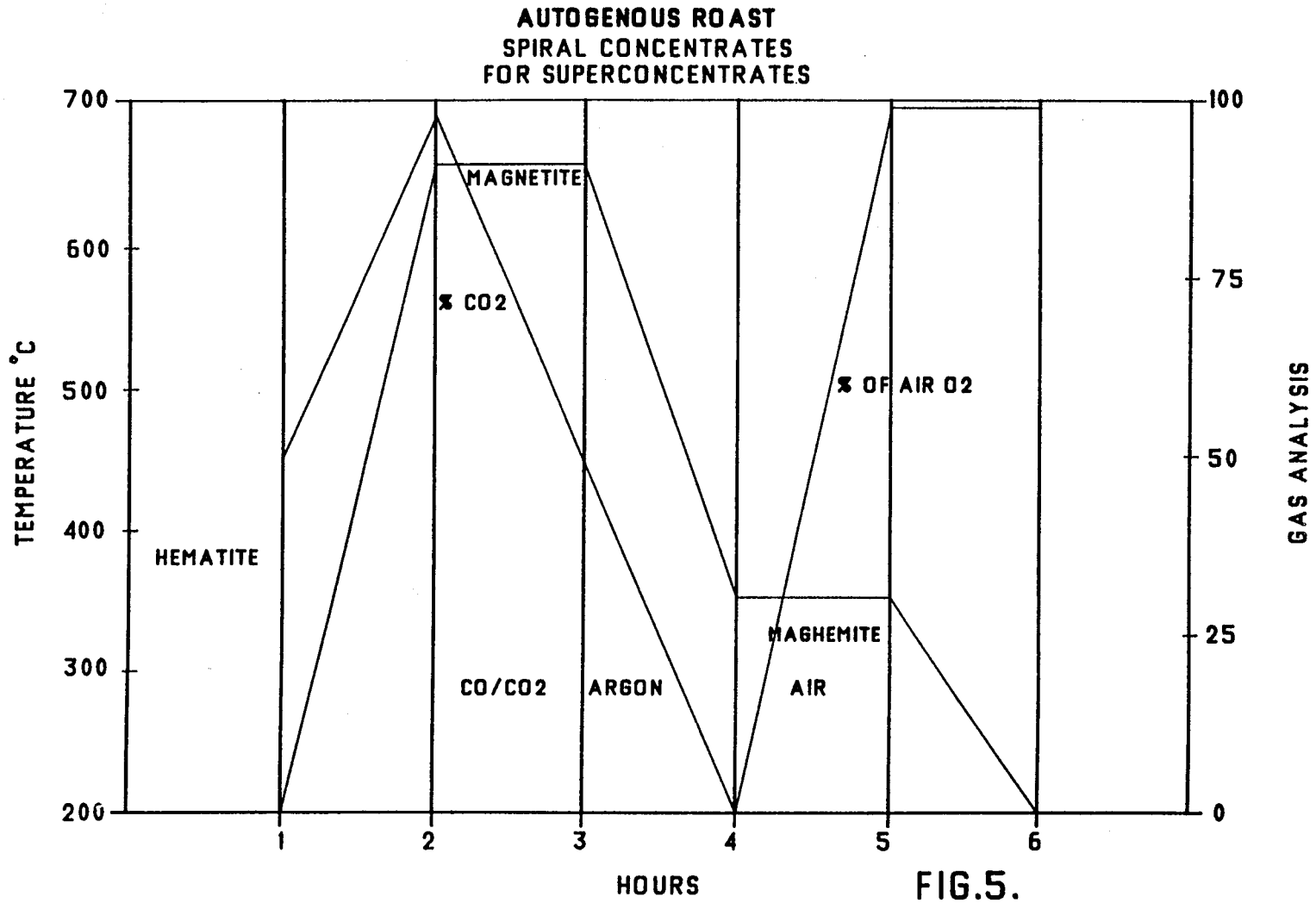
FIG. 5 illustrates in graphical form the process cycle effected during an autogenous roast process effected in accordance with the invention.

To illustrate the process cycle employed in the autogenous roast process of the invention, the sequence of events in a small batch cooler now is described with reference to FIG. 5 as a specific illustration of the process of the invention.

As a mixed magnetite/hematite spiral concentrate is heated, reaction starts at 1 hour. The reduction gas employed is 60% CO/40% $CO_2$. Gas flow is 0.5 cfm/lb. of concentrate. CO is converted to $CO_2$ in the hematite reduction step, the $CO_2$ content of the gas stream rising to 100% at 2 hours. Reduction of the hematite content of the feed to magnetite is completed at 3 hours, at 650° C.

A neutral cooling gas, such as argon, is used to assist subsequent cooling of the magnetite from 650° C. to 350° C. between 3 and 4 hrs.

Following cooling to the desired temperature, a flow of cold air at 0.5 cfm/lb. of magnetite is started at 4 hours. All magnetite is converted to gamma hematite by 5 hours and the gamma hematite is further cooled to ambient temperature over a further 1 hour period.

Heating iron ore concentrate grains shatters some grains containing minerals having different thermal expansion rates. Quartz is a common constituent of mixed iron ore concentrate grains. Phase inversion of quartz at 572° C. gives a volume expansion differential of about 4% compared to magnetite.

Figure 6:
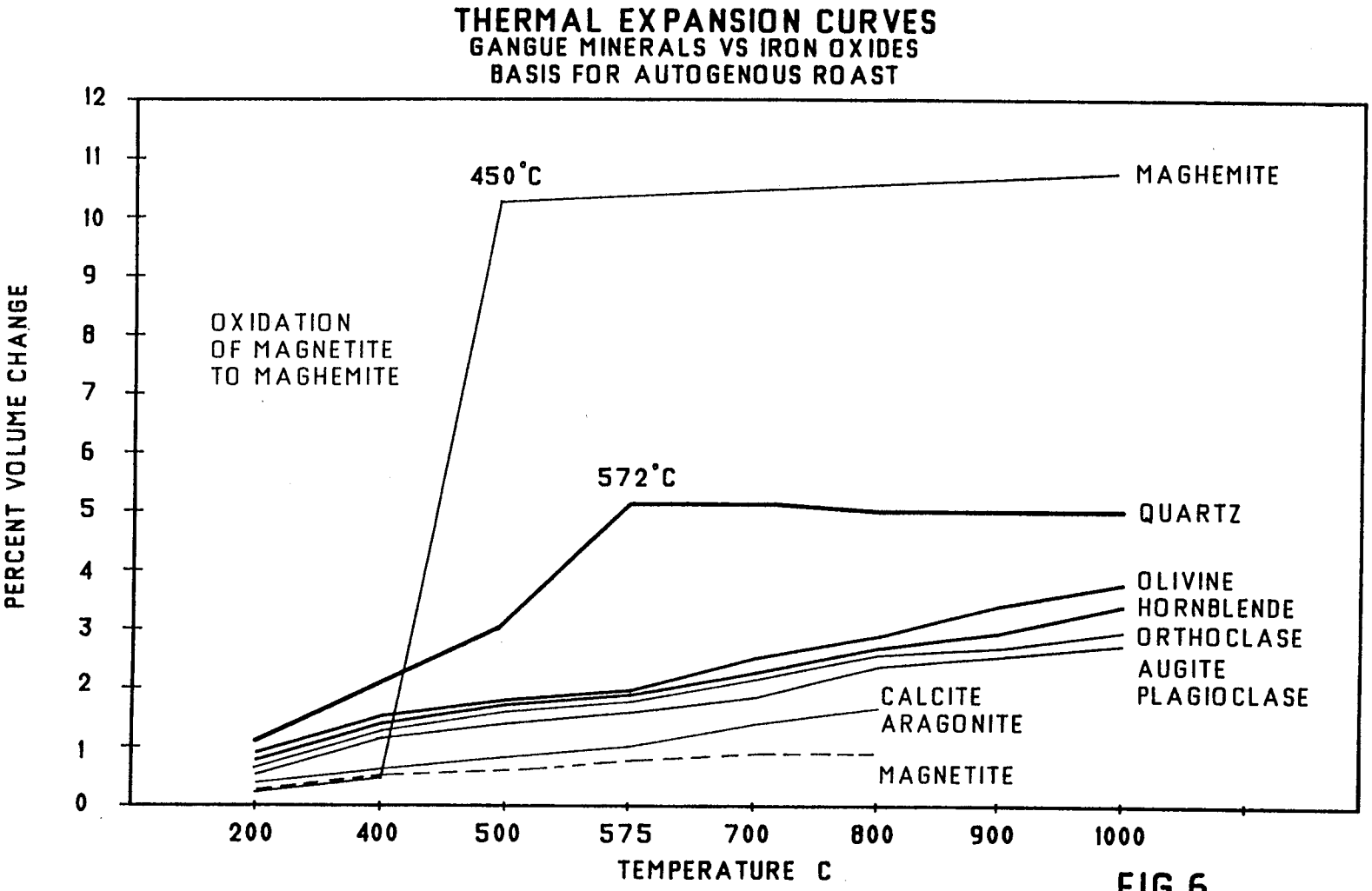
FIG. 6 contains thermal expansion curves for various substances.

At the conversion temperature of magnetite to gamma hematite, such mixed grains are shattered, producing popping sounds. The much larger differential expansion when magnetite is converted to gamma hematite is a basic reason for the success of superconcentration by magnetic concentration following the autogenous roasting method (see FIG. 6).

A sensitive directional microphone with noise filter can pick up and record the "pop rate" within the rotary coolers. Pop rate recorders on the first reduction stage, and the third oxidation stage can provide assistance in process control. If the pop rate changes, temperature or gas rate can be automatically controlled to achieve the desired rate.

An overall heat balance has been calculated for an initial spiral concentrate at 65% iron and a ratio of 60% magnetite/40% hematite, roasted at 1500° F., as shown in the following Table I:

TABLE I

| BTU/2000 LB TON OF FEED | | | |
|---|---|---|---|
| Heated Required | | Heat Available | |
| 2% moisture evaporate | 40,000 | Sensible heat ore | 471,000 |
| Raise ore temperature | 581,000 | Heat exhaust | 78,000 |
| Heat oxidation air | 116,000 | Primary oxidation | 275,000 |
| Heat carbon monoxide | 41,000 | Reduction with CO | 96,000 |
| Heat losses | 350,000 | Oxid. to gamma | 504,000 |

TABLE I-continued

| BTU/2000 LB TON OF FEED | | | |
|---|---|---|---|
| Heated Required | | Heat Available | |
| Total | 1,128,000 | Hem | 1,424,000 |

As can be seen, the heat available for the process, arising from the noted operations, exceeds the heat requirements of the process, so that the process can be self-sustaining with respect to heat requirements.

One useful application of the present invention is the production of low silica concentrates from operating iron mines, such as those in the Labrador Trough. The producing deposits mine iron ore generally containing less than about 40% iron. This material usually is ground to less than 10 mesh particle size, concentrated and then fine ground and pelletized to form pellets suitable for blast furnace feed.

Pellet specifications for blast furnace feed generally include a maximum silica content of 6 wt. % and an iron content of over 65 wt. %, i.e. about 92% of the purity of 100% iron oxide containing about 70% iron and 30% oxygen. Silica is required in the blast furnace to promote slag formation to dissolve and remove other purities.

Recent studies have indicated that by decreasing the silica content of the pellets below about 3 wt. % leads to a significant increase in blast furnace production. The autogenous roast procedure enables high purity concentrates of less than 0.5% silica to be obtained from the current 92% pure iron concentrates containing about 6% silica.

The resulting low silica concentrate therein can be blended with concentrate containing about 6 wt. % silica to obtain a blend containing a desired lower silica content, preferably below about 3 wt. % silica. By operating in this way, it is unnecessary to upgrade all the current 6% silica concentrate to produce a 3% silica pellet. This procedure may be used to form a blend of desired lower silica content from a concentrate containing any silicon content, generally at least about 3 wt. %.

For example, blending 100 tons of 0.5% silica high purity (99%) concentrate formed by the autogenous roasting process of the invention with 80 tons of 6% silica standard concentrate produces 180 tons of 2.9% silica pellet feed.

Using the autogenous roasting procedure of the invention, approximately 110 tons of standard concentrate are required to make 100 tons of 0.5% silica high purity concentrate. Accordingly, about 60% of the standard pellet feed concentrate may be autogenously roasted by the process of the invention and magnetically concentrated to form the 99% purity blending material, while the remaining 40% of the standard concentrate is blended with the high purity material to make the low silica pellet feed.

In current spiral concentrate flow sheets, rougher spirals reject a low iron tailing, resulting in a high iron recovery, medium iron content first concentrate at between 45 and 50% iron, which then is a suitable feed for an autogenous roast of some of the product, leading to an overall higher iron recovery for the flowsheet.

DESCRIPTION OF PREFERRED EMBODIMENTS

Referring to the drawings, FIG. 1 illustrates schematically an autogenous roast process 10 provided in accordance with one embodiment of the invention. As seen therein, a concentrate feed containing magnetite and hematite is fed by line 12 to a first step oxidation-reduction reactor 14 wherein the concentrate feed is initially preheated by hot air recycled by line 16 and by line 18 while the magnetite content of the concentrate feed is converted to hematite. The thermal energy generated along with that recycled is sufficient to maintain the succeeding reduction operation. An exhaust air stream is vented from the reactor 14 by line 20. The heated concentrate then is reduced with carbon monoxide fed to the reactor 14 by line 22 to convert hematite to magnetite.

The reduced concentrate, in which the iron values comprise magnetite, is forwarded by line 24 to a cooling chamber 26, wherein the hot concentrate is cooled to a lower temperature in a neutral gas atmosphere. An ambient temperature air stream is fed by line 28 to cool the outside of the cooling chamber 26. Hot air resulting from the cooling operation is forwarded by line 18 to the reactor 14.

The cooled concentrate is forwarded by line 30 to a third step oxidation reactor 32 wherein the magnetite is oxidized to gamma hematite and cooled by ambient air fed by line 34. Nitrogen remaining after removal of oxygen from the air in the oxidation step, is forwarded by line 16 to the cooling chamber 2 and to the first stage reactor 14. The product gamma hematite concentrate is removed by line 36 from the third stage reactor 32. Typical operating temperatures for the various stages and gas streams are given in FIG. 1.

In FIG. 2, there is shown an alternative autogenous roasting procedure in which rotary coolers 1, 2 and 3 are employed at various stages of operation. The operations which are effected are the same as those described above with respect to FIG. 1.

FIG. 3 illustrates a further autogenous roasting procedure. In this case, an integrated structure 100 is provided in which the operations are effected in contiguous regions of the roaster. The roaster is equipped with electric heating elements to provide the initial energy to bring the system up to the required autogenous roasting temperature.

FIG. 4 is a sectional view of the first stage of the roaster 100 of FIG. 3, showing a rotating metal tube 102 in which the procedures are effected along with lifters 104.

EXAMPLE

This Example illustrates the practical utility of the process of the present invention in producing very low silica concentrates from concentrates from operating iron mines in the Labrador Trough.

A standard iron concentrate from a Labrador Trough iron mine was processed as described below. The iron concentrate contained both magnetite and hematite and analyzed 66.07% Fe and 5.03% $SiO_2$. The complete analysis of the concentrate is given below.

An externally-heated rotary kiln alloy metal tube, 8 inches in diameter and 10 feet long, Was operated in batch mode using 25 lb. samples using a mixed carbon monoxide and carbon dioxide gas stream for concentrate reduction and an argon gas stream for cooling. The samples were subjected to a cycle of operations, as follows:

(a) oxidation of magnetite in the concentrate to hematite during heat up of the kiln to 650° C., (b) reduction of hematite to artificial magnetite by carbon monoxide at 650° C., (c) cooling of the reduced product in argon to 350° C., and (d) oxidation of the artificial magnetite to gamma hematite at 350° C.

The resulting product then was subjected to magnetic separation, which resulted in a high purity gamma hematite accepts fraction having a very low silica content and a tailings fraction rich in silica. The overall iron recovery in the accepts fraction from the feed was 92.52% while the accepts fraction concentrate represented 85.4 wt. % of the initial feed to the rotary kiln.

The analysis of the initial concentrate, final concentrate and tailings stream is set forth in the following Table II:

TABLE II

| | Concentrate (wt %) | | |
|---|---|---|---|
| | Initial | Final | Tailings (wt %) |
| Fe | 66.07 | 71.45 | 34.6 |
| $SiO_2$ | 5.03 | 0.45 | 25.4 |
| $Al_2O_3$ | 0.32 | | |
| CaO | 0.025 | | |
| MgO | 0.023 | | |
| $TiO_2$ | 0.13 | | |
| MnO | 0.028 | | |
| $P_2O_5$ | 0.030 | | |
| $Na_2O$ | 0.004 | | |
| $K_2O$ | 0.013 | | |
| $Fe_3O_4$ | 1.03 | | |
| Moisture | 2.26 | | |

SUMMARY OF DISCLOSURE

In summary of this disclosure, the present invention provides a closed cycle system of autogenous roasting, particularly of iron ore to form magnetic gamma hematite, which, after being brought up to operating temperature, and steady operating conditions, is self-sustaining. Modifications are possible within the scope of this invention.

What I claim is:

1. A process for the thermal conversion of iron ore to magnetic gamma hemitite, which comprises the steps of:

(a) preheating an iron ore concentrate feed to effect oxidation of magnetite therein to hematite, (b) reducing hematite contained in the oxidized concentrate to magnetite, (c) cooling the reduced concentrate to a lower temperature, (d) oxidizing magnetite in the cooled charge to magnetic gamma hematite, and (e) employing exothermic heat from said cooling and magnetite oxidation steps in said preheating step (a), whereby, after being brought up to operating temperature and steady operating conditions, said thermal conversion is effected in an autogenous closed cycle of thermal energy which is self-sustaining.

2. The process of claim 1 wherein said reduction step (b) is effected at a maximum temperature of about 700° C. using carbon monoxide, said cooling step (c) is effected to cool the reduced concentrate to about 400° C., and said magnetite oxidizing step (d) is effected at a temperature below about 400° C.

3. The process of claim 2 wherein said carbon monoxide is employed in a gas mixture with carbon dioxide having an initial volume ratio of at least about 60:40.

4. The process of claim 2 wherein thermal energy resulting from said cooling step (c) is recycled to said reducing step (b) to assist in maintaining the desired temperature in said step (b).

5. The process of claim 2 wherein said cooling step (c) is effected at least partially by conductance and radiation from a metal shell of a rotary cooler.

6. The process of claim 2 wherein said oxidizing step (d) includes a shattering of particles of concentrate which produces an audible sound and the rate of such shattering is monitored as a control of said oxidizing step.

7. The process of claim 6 wherein the magnetic gamma hematite resulting from step (d) is cooled to ambient temperature at least partially by conductance and radiation from a metal shell of a rotary cooler.

8. The process of claim 1 wherein said magnetic gamma hematite is subsequently concentrated magnetically to produce a highly purified (>99%) iron oxide concentrate.

9. In a process for forming pelletized iron ore concentrate for feed to a blast furnace wherein finely-divided iron ore concentrate is pelletized, the improvement which comprises:

providing a first iron ore concentrate containing hematite and magnetite and having an iron content of at least about 60 wt. % and a silica content of at least about 3 wt. %, subjecting a portion of said first iron ore concentrate to a roasting operation to convert hematite and magnetite to magnetic gamma hematite wherein iron ore particles shatter and free occluded minerals including silica, magnetically concentrating said magnetic gamma hematite to form a second iron ore concentrate having an iron oxide content greater than 99% and containing less than 0.5 wt. % silica, and blending the remainder of said first iron ore concentrate with said second iron ore concentrate to form a blended iron ore concentrate as pelletizer feed.

10. The process of claim 9 wherein said first iron ore concentrate has a silica content of about 5 to 6 wt. % and said blending step produces a blended iron ore concentrate having a silica content below about 3 wt. %.

11. The process of claim 10 wherein said roasting operation is effected in an autogenous closed cycle of thermal energy which, after being brought up to operating temperature and steady operating conditions, is self-sustaining.

* * * * *